US011105013B2

(12) United States Patent
Benaben et al.

(10) Patent No.: US 11,105,013 B2
(45) Date of Patent: Aug. 31, 2021

(54) IONIC LIQUID ELECTROLYTE AND METHOD TO ELECTRODEPOSIT METALS

(71) Applicants: Patrick Benaben, Saint-Maximin (FR); Joan Brennecke, Notre Dame, IN (US); Edward Maginn, Notre Dame, IN (US); Mauricio Quiroz-Guzman, South Bend, IN (US)

(72) Inventors: Patrick Benaben, Saint-Maximin (FR); Joan Brennecke, Notre Dame, IN (US); Edward Maginn, Notre Dame, IN (US); Mauricio Quiroz-Guzman, South Bend, IN (US)

(73) Assignees: Neo Industries LLC, Portage, IN (US); University of Notre Dame Du Lac, Notre Dame, IN (US); Ionic Research Technologies LLC, South Bend, IN (US)

( * ) Notice: Subject to any disclaimer, the term of this patent is extended or adjusted under 35 U.S.C. 154(b) by 338 days.

(21) Appl. No.: 14/686,184

(22) Filed: Apr. 14, 2015

(65) Prior Publication Data

US 2015/0292098 A1 Oct. 15, 2015

Related U.S. Application Data

(60) Provisional application No. 61/979,705, filed on Apr. 15, 2014.

(51) Int. Cl.
*C25D 3/10* (2006.01)
*C25D 3/66* (2006.01)
(Continued)

(52) U.S. Cl.
CPC ..... *C25D 3/10* (2013.01); *C25D 3/06* (2013.01); *C25D 3/665* (2013.01); *C25D 3/08* (2013.01)

(58) Field of Classification Search
CPC ..... C25D 3/66–665; C25D 3/06
See application file for complete search history.

(56) References Cited

U.S. PATENT DOCUMENTS 3,910,774 A * 10/1975 Krienke ..... C25D 3/48 184/5.1
4,906,342 A * 3/1990 Takahashi ..... C25D 3/44 205/233
(Continued)

FOREIGN PATENT DOCUMENTS

CN 1884622 A 12/2006
CN 101054698 A 10/2007
(Continued)

OTHER PUBLICATIONS

Sun & Brennecke, Characterization of Imidazolium Chloride Ionic Liquids Plus Trivalent Chromium Chloride for Chromium Electroplating, Ind. Eng. Chem. Res. (2015).*
(Continued)

*Primary Examiner* — Brian W Cohen
*Assistant Examiner* — Ho-Sung Chung
(74) *Attorney, Agent, or Firm* — Crowell & Moring LLP

(57) ABSTRACT

An electrolyte and a method to electroplate a metal on a substrate using the electrolyte are described. The electrolyte includes an imidazolium compound, a metal salt, and water. The imidazolium compound has formula (I)

(I)

(Continued)

wherein $R^1$, $R^2$, $R^3$, $R^4$, and $R^5$ are each independently selected from an H atom and an organic radical. $L^-$ is a compatible anion. The metal salt can include but is not limited to salts of the metals Li, Mg, Ca, Cr, Mn, Fe, Co, Ni, Cu, Zn, Cd, Pb, Bi, La, Ce, Al, Ag, Au, Ga, V, In, Nb, Mo, and W.

13 Claims, 12 Drawing Sheets

(51) Int. Cl.
*C25D 3/06* (2006.01)
*C25D 3/08* (2006.01)

(56) References Cited

U.S. PATENT DOCUMENTS

2013/0264222 A1* 10/2013 Bae ..... G01N 27/4166 205/782
2016/0369418 A1* 12/2016 Goto ..... C25D 3/665

FOREIGN PATENT DOCUMENTS

CN 101555608 A 10/2009
CN 101629312 A 1/2010
CN 102433575 A 5/2012
CN 102766891 A 11/2012
CN 102912380 A 2/2013
CN 103046081 A 4/2013
CN 103046082 A 4/2013
WO WO 2011/09878 9/2011

OTHER PUBLICATIONS

Abbott & McKenzie, Application of Ionic Liquids to the Electrodeposition of Metals, 8 Phys. Chem. Chem. Phys. 4265 (2006).*
Lou & Huang, Electroplating, Encyclopedia of Chem. Proc. (2006).*
Bard et al., Electrochemical Dictionary (2008).*
Ferreira et al., Electrochemical studies of metallic chromium electrodeposition from a Cr(III) bath, 707 J. ElectroAnal. Chem. 52 (2013).*
Yang et al., Single-step large-scale and template-free electrochemical growth of Ni—Zn alloy filament arrays from a zinc chloride based ionic liquid, 46 Chem. Commun. 2686 (2010).*
ChemicalBook, 1-ethyl-3-methylimidazolium chloride, http://www.chemicalbook.com/ChemicalProductProperty_EN_CB5428700.htm (2013).*
Fendt et al., Viscosities of Acetate or Chloride-Based Ionic Liquids and Some of Their Mixtures with Water or Other Common Solvents, 56 J. Chem. Eng. Data 56 (2011).*
Abbott, A. et al, "Electroplating Using Ionic Liquids", *Annual Review of Materials Research*, vol. 43, No. 1, Jan. 16, 2013, pp. 335-358.
Eugenio, S. et al, "Electrochemical Aspects of Black Chromium Electrodeposition from I-butyl-3methylimidazolium Tetrafluoroborate Inonic Liquid", *Electrochimica Acta*, vol. 56, No. 28, Mar. 31, 2011, pp. 10347-10352.
Survillene, S. et al., "Chromium Electrodeposition from [BMIm] [$BF_4$] Ionic Liquid", *Journal of Applied Electrochemistry*, vol. 41, 2011, pp. 107-114.
International Search Report and Written Opinion for PCT/US2015/025706 dated Jul. 20, 2015, 13 pages.
O'Mahony, A. M., et al., "Effect of Water on the Electrochemical Window and Potential Limits of Room-Temperature Ionic Liquids", *Journal of Chemical & Engineering Data*, No. 53, vol. 12, 2008, pp. 2884-2891.
Ren, N. et al., "Surface Tension Measurements for Seven Imidazolium-Based Dialkylphosphate Ionic Liquids and Their Binary Mixtures with Water (Methanol or Ethanol) and 298.15 K and 1 atm", *Journal of Chemical & Engineering Data*, vol. 59, 2014, pp. 189-196.
Singh, T. et al., "Cation-Anion-Water Interactions in Aqueous Mixtures of Imidazolim Based Ionic Liquids", *Vibrational Spectroscopy*, vol. 55, 2011, pp. 119-125.
Zhang, Q. et al. "Effects of I-butyl-3-methylimidazolium hydrogen sulfate-[BMIM] HSO4 on Zinc Electrodeposition from Acidic Sulfate Electrolyte", *J. Appl. Electrochem*, vol. 39, 2009, pp. 261-267.
Abbott, A. et al., "Application of Ionic Liquids to the Electrodeposition of Metals", *Phys. Chem., Chem. Phys.*, vol. 8, 2006, pp. 4265-4279.
Zhang, Q., "Study on Mechanism of Mowuchi Ionic Liquid in Zinc Electrodeposition", *Kunming University of Science PhD Thesis*, 2011, 30 pages.
Qifei, P et al. "Effect of Water on the Electrodeposition of Aluminum by AlC13-BMIC Ionic Liquid", *Chinese Journal of Nonferrous Metals*, vol. 22, 2012, pp. 1468-1474. English Abstract included.
English language translation of Office Action in Chinese Application No. 201580026488.8, dated Feb. 1, 2018, 11 pages.
Docherty, Kathryn M. et al., "Biodegradability of Imidazolium and Pyridinium Ionic Liquids by an Activated Sludge Microbial Community," Biodegradation (2007) 18:481-493, 13 pages.
Organization for Economic Cooperation and Development (OECD), Report on Choline Chloride, Unep Publications, 2004, 135 pages.
Smith, Emma L. et al., Deep Eutectic Solvents (DESs) and Their Applications, Chemical Reviews (2014) 114, 11060-11082, American Chemical Society, 23 pages.
Excerpt from Mu, T. and Han, B., "Structures and Thermodynamic Properties of Ionic Liquids," pp. 107-140 in Zhang et al. (editors) (2014) Structures and Interactions of Ionic Liquids, Heidelberg, Germany, Springer, ISBN 978-3-642-38618-3, 6 pages.
Bartlett, Philip N., et al., Halometallate Complexes of Germanium(II) and (IV): Probing the Role of Cation, Oxidation State and Halide on the Structural and Electrochemical Properties, ChemPubSoc Europe, DOI: 10.1002/chem.201400179, Chem.Eur.J. 2014, 20, 5019-5027, Wiley Online Library, 9 pp.
De Vreese, Peter, et al., Speciation of Copper(II) Complexes in an Ionic Liquid Based on choline Chloride and in Choliine Chloride/Water Mixtures, Inorganic Chemistry, ACS Publications, 4972-4981, 10 pp.
Endres, F., et al., On the electrodeposition of titanium in ionic liquids, Phys. Chem. Chem. Phys. vol. 10, 2189-2199, www.rsc.org/pccp, downloaded by Duke University on Sep. 28, 2012, Published on Feb. 27, 2008 on http://pubsrsc.org, 11 pp.
Surviliene, S., et al., Effect of Cr(III) solution chemistry on electrodeposition of chromium, Journal of Applied Electrochemistry (2006) 36:649-654, 6 pp.
Electrodeposition from Ionic Liquids, Frank Endres, et al., ed., Wiley VCH Verlag GmbH & Co, 2008, Chapters 2-3, pp. 15-82, total pp. 80.
R.P. Renz, et al., A Functional Trivalent Chromium Process to Replace Hexavalent Chromium Plating, Faraday Technoogy, Inc., AESF/EPA Conference for Environmental & Process Excellence, ©2003 AESF, pp. 196-207.
G. Hong, et al., Hard Chromium Plating From Trivalent Chromium Solution, Plating & Surface Finishing, Mar. 2001, pp. 69-75.
J. Pina et al., Residual stresses and crystallographic texture in hard-chromium electroplated coatings, Elsevier, Surface and Coating Technology 96 (1997) 148162, accepted Feb. 3, 1997, pp. 149-162.
N.M. Martyak et al., Microcracks in chromium electrodeposits, Journal of Meterials Science 32 (1997) 6069-6073, ResearchGate, accepted Apr. 24, 1996, 6 pp.
D. Smart et al., A Novel Trivalent Chromium Electroplating Bath, Transactions of the IMF, The International Journal of Surface Engineering and Coatings, 7 pp., ISSN: 0020-2967 (Print) 1745-9192 (Online) Journal homepage: http:www.tandfonline.com/loi/ytim20.

* cited by examiner

Fig. 6A
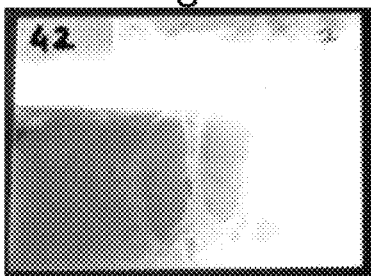
Fig. 6B
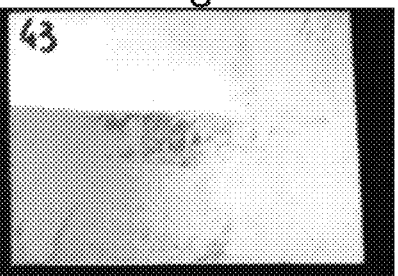
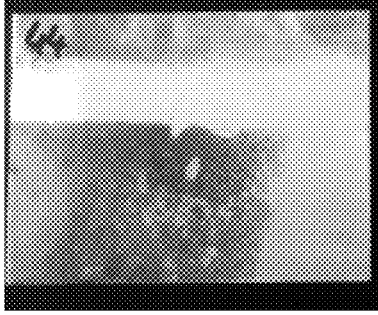
Fig. 6C
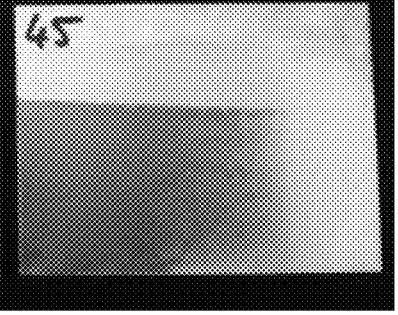
Fig. 6D
Fig. 6E
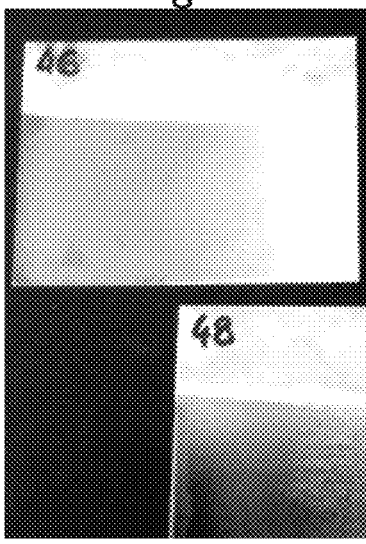
Fig. 6F
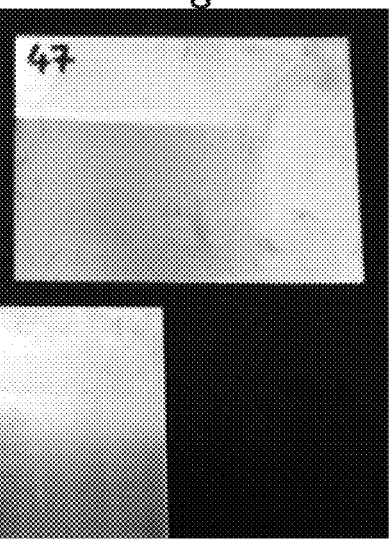
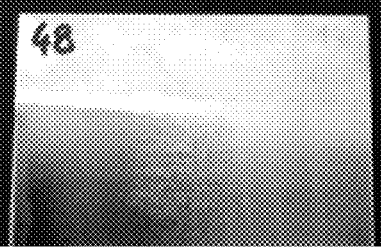
Fig. 6G Fig. 6H Fig. 6I
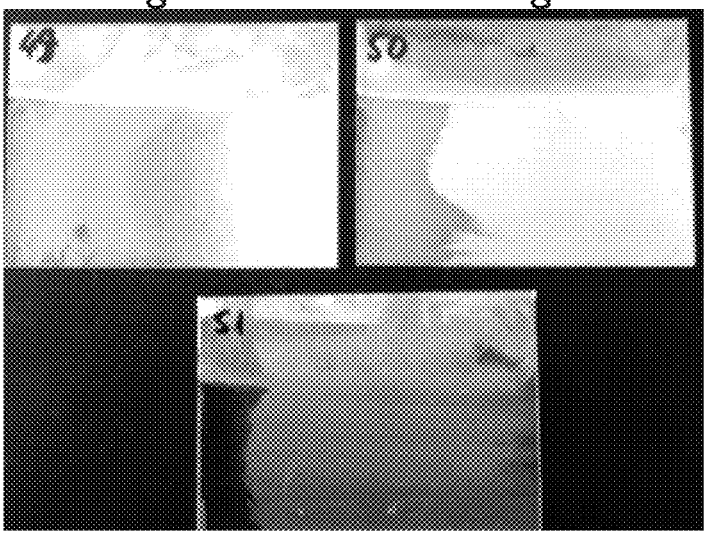
Fig. 6J
Fig. 6K Fig. 6L
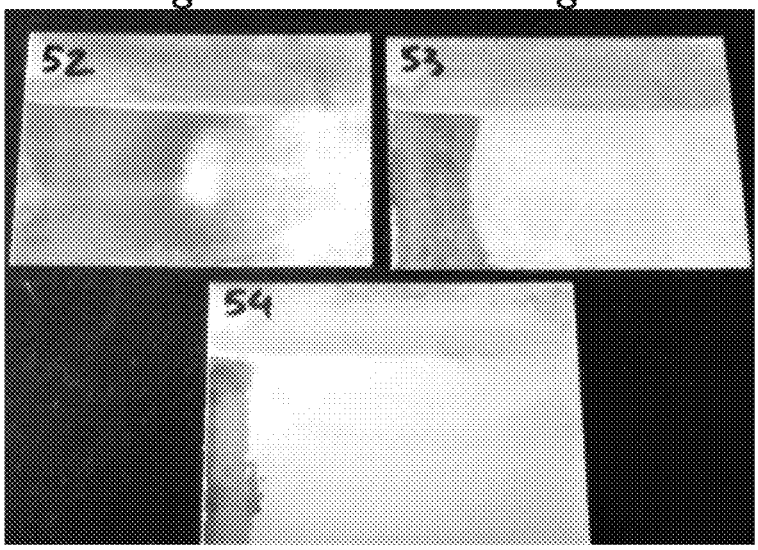
Fig. 6M Fig. 8A Fig. 8D Fig. 8F
Fig. 8B
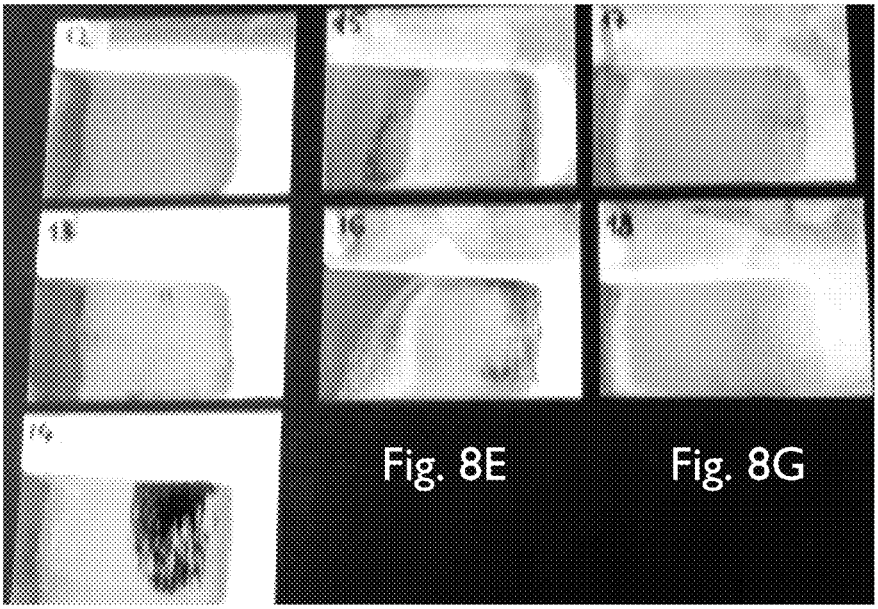
Fig. 8E Fig. 8G
Fig. 8C
Fig. 8H Fig. 8J Fig. 8M
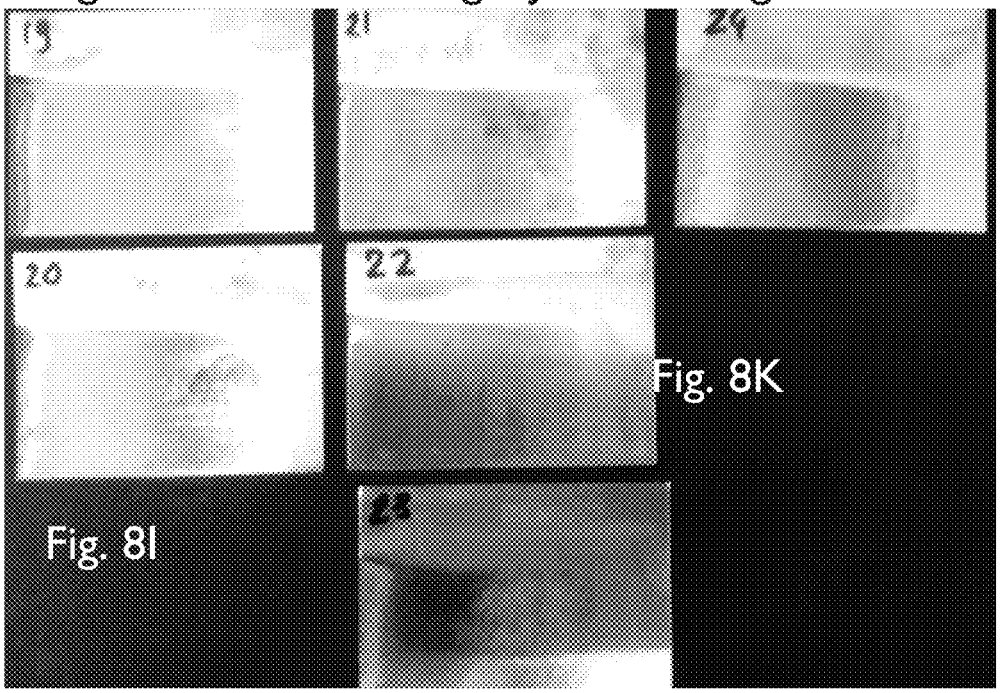
Fig. 8K
Fig. 8I
Fig. 8L

IONIC LIQUID ELECTROLYTE AND METHOD TO ELECTRODEPOSIT METALS

This application claims priority to U.S. Provisional Patent Application No. 61/979,705 filed on Apr. 15, 2014, the entire contents of which are incorporated herein by reference.

This invention was made with government support under IIP1237829 awarded by the National Science Foundation. The government has certain rights in the invention.

BACKGROUND

The present method relates to an ionic liquid electrolyte and a method to electroplate metal on a substrate using an electrolyte that includes an imidazolium compound, a metal salt, and water. In one embodiment, the imidazolium compound has the general formula (I):

(I)

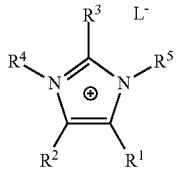

wherein $R^1$, $R^2$, $R^3$, $R^4$, and $R^5$ are each independently selected from an H atom and an organic radical having from 1 to 20 carbon atoms. $L^-$ is a compatible anion.

Chromium plating is a surface treatment used in many industrial applications to increase wear resistance, to improve friction coefficient of parts which are treated and to provide a nice surface aspect (decorative application). Currently, this surface treatment is conducted using as an electrolyte aqueous solutions of hexavalent chromium (Cr (VI) as chromium trioxide $CrO_3$, which becomes chromic acid in water). The cathodic reduction of Cr(VI) to metallic chromium Cr(O) takes place under the condition that catalytic products as sulfuric, fluorosilicate, or organosulfonic ions are present in the bath. The thickness of deposits of hard chromium plated parts is a function of the duration of the plating operation and can vary from 0.1 micrometers (decorative application) to several hundred micrometers (functional application).

Unfortunately, hexavalent chromium compounds are considered to be highly toxic and carcinogenic. Thus, even though no hexavalent chromium is present at the surface of the treated parts after electrolytic reduction for chromium plating and even if the process is strictly controlled and managed during application there is a desirability to replace chromium plating using Cr(VI) by other, more environmentally friendly treatments.

SUMMARY

Accordingly, the present invention relates to an ionic liquid electrolyte and a method to electroplate a substrate using an ionic liquid electrolyte that includes an imidazolium compound, a metal salt, and water. In one embodiment the imidazolium compound has the general formula (I), below. The substrate may include a metal or a conductive layer on a substrate. The resulting metal layer has a thickness of at least 0.1 μm. The process can be conducted at a temperature between about 20° to about 80° C. and at current densities between about 1 to 200 A/dm$^2$.

In other embodiments, the ionic liquid electrolyte consists essentially of an imidazolium compound, a metal salt, and water. In yet other embodiments, the ionic liquid electrolyte consists of an imidazolium compound, a metal salt, and water.

The imidazolium compound can have the general formula (I):

(I)

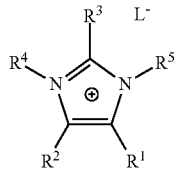

wherein $R^1$, $R^2$, $R^3$, $R^4$, and $R^5$ are each independently selected from an H atom and an organic radical, which in some embodiments may have from 1 to 20 carbon atoms. $L^-$ is a compatible anion.

$L^-$ is a compatible anion that can include but is not limited to halide anions, carboxylate anions, oxides, organic sulfite or sulfate, inorganic sulfite or sulfate, sulfonate including organo and alkyl sulfonates such as but not limited to methyl, ethyl, propyl, butyl, sulfonate, sulfamate, carbonate, nitrate, nitrite, thiocyanate, hydroxide, sulfonylimide, phosphates such as hexafluorophosphates, phosphonates, phosphinates, phosphites, phosphonites and phosphinites, borates such as tetrafluoroborate, carboxylates, acetates such as trifluoracetate, triflate and halogenated hydrocarbons. Accordingly, the compatible anion can include, but is not limited to, $F^-$, $Cl^-$, $Br^-$, $I^-$, $NO_2^-$, $NO_3^-$, the group of sulfates, sulfites and sulfonates (including alkylsulfonates), e.g. $SO_4^{2-}$, $HSO_4^-$, $SO_3^{2-}$, $HSO_3^-$, $H_3COSO_3^-$, $H_3CSO_3^-$, phenylsulfonate, p-tolylsulfonate, $HCO_3^-$, $CO_3^{2-}$, the group of alkoxides and aryloxides, e.g. $H_3CO^-$, $H_5C_2O^-$, the group of phosphates, phosphonates, phosphinates, phosphites, phosphonites and phosphinites, e.g. $PO_4^{3-}$, $HPO_4^{2-}$, $H_2PO_4^-$, $PO_3^{3-}$, $HPO_3^{2-}$, $H_2PO_3^-$, the group of carboxylates, e.g. formate and acetate, and the group of halogenated hydrocarbons, e.g. $CF_3SO_3^-$, $(CF_3SO_3)_2N^-$, $CF_3CO_2^-$ and $CCl_3CO_2^-$.

The metal salt can include but are not limited to salts of metals, alkalis, rare earth and other salts such as but not limited to Li, Mg, Ca, Cr, Mn, Fe, Co, Ni, Cu, Zn, Cd, Pb, Bi, La, Ce, Al, Ag, Au, Ga, V, In, Nb, Mo, and W. The anion forming the metal salt can be the same as or different from $L^-$. The metal salt can be unhydrated or hydrated.

The molar ratio of the imidazolium compound to metal salt can range from about 0.2:1 to about 10:1, or from about 0.5:1 to about 5:1, or from about 1:1 to about 2:1.

An advantage of the materials in accordance with the invention is that when they are used in electrolytic baths, in particular plating or electropolishing baths, hydrogen evolution is significantly reduced, as compared with conventional acidic baths. As a result, reduced hydrogen evolution can improve the safety of the process and reduce the amount of hydrogen embrittlement that may occur in the substrate material during the electrochemical process. The process according to the present invention may also result in plated materials having an improved surface finish.

BRIEF DESCRIPTION OF THE DRAWINGS

FIGS. 3A-2D are photographs of substrates treated with the method and electrolyte of Example 2.

FIGS. 6A-6M are photographs of substrates treated with the method and electrolyte of Example 5.

FIGS. 8A-8M are photographs of substrates treated with the method and electrolyte of Example 7.

DETAILED DESCRIPTION

Figure 1:
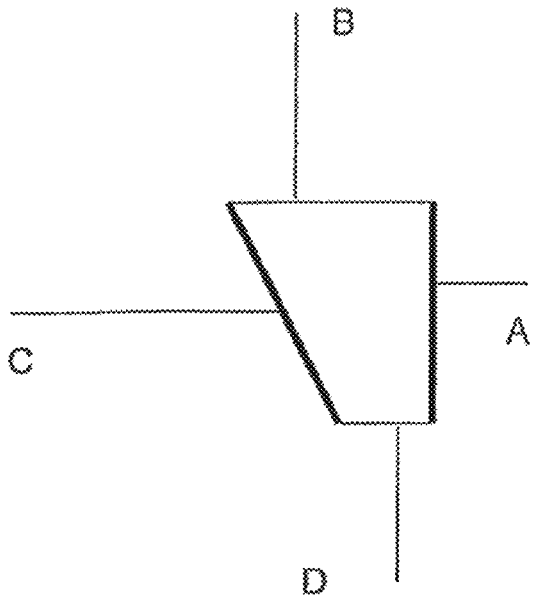
FIG. 1 is a schematic diagram of a Hull cell used during testing.

The present invention relates to an ionic liquid electrolyte and a method to electroplate metal on a substrate using an ionic liquid electrolyte that includes an imidazolium compound, a metal salt, and water. Typically, the substrate is a metal selected from the group consisting of steel, nickel, aluminum, brass, copper and alloys of these metals.

The imidazolium compound can have the general formula (I):

(I)

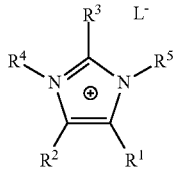

wherein $R^1$, $R^2$, $R^3$, $R^4$, and $R^5$ are each independently selected from an H atom and an organic radical. $L^-$ is a compatible anion.

In some embodiments, $R^1$, $R^2$, $R^3$, $R^4$, and $R^5$ are each independently selected from hydrogen and an organic radical having from 1 to 20 carbon atoms and each can be the same or different. In other embodiments, at least one of $R^1$, $R^2$, and $R^3$ are hydrogen and $R^4$ and/or $R^5$ is a $C_1$ to $C_{20}$ alkyl. Alternatively, $R^4$ and/or $R^5$ is $C_1$ to $C_8$ alkyl. In other embodiments at least two of $R^1$, $R^2$, and $R^3$ are hydrogen and $R^4$ and/or $R^5$ is a $C_1$ to $C_{20}$ alkyl. In still other embodiments each of $R^1$, $R^2$, and $R^3$ are hydrogen and $R^4$ and/or $R^5$ is a $C_1$ to $C_{20}$ alkyl.

$L^-$ is a compatible anion that can include but is not limited to halide anions, carboxylate anions, oxides, organic sulfite or sulfate, inorganic sulfite or sulfate, sulfonate including organo and alkyl sulfonates such as but not limited to methyl, ethyl, propyl, or butyl sulfonate, sulfamate, carbonate, nitrate, nitrite, thiocyanate, hydroxide, sulfonylimide, phosphates such as hexafluorophosphates, phosphonates, phosphinates, phosphites, phosphonites and phosphinites, borates such as tetrafluoroborate, carboxylates, acetates such as trifluoracetate, triflate and halogenated hydrocarbons. Accordingly, the compatible anion can include, but is not limited to, $F^-$, $Cl^-$, Br, $I^-$, $NO_2^-$, $NO_3^-$, the group of sulfates, sulfites, sulfonates, alkyl sulfonates, and alkyl sulfamates, e.g. $SO_4^{2-}$, $HSO_4^-$, $SO_3^{2-}$, $HSO_3^-$, $H_3COSO_3^-$, $H_3CSO_3^-$, phenylsulfonate, p-tolylsulfonate, $HCO_3^-$, $CO_3^{2-}$, the group of alkoxides and aryloxides, e.g. $H_3CO^-$, $H_5C_2O^-$, the group of phosphates, phosphonates, phosphinates, phosphites, phosphonites and phosphinites, e.g. $PO_4^{3-}$, $HPO_4^{2-}$, $H_2PO_4^-$, $PO_3^{3-}$, $HPO_3^{2-}$, $H_2PO_3^-$, the group of carboxylates, e.g. formate and acetate, and the group of halogenated hydrocarbons, e.g. $CF_3SO_3^-$, $(CF_3SO_3)_2N^-$, $CF_3CO_2$ and $CCl_3CO_2^-$. Suitable alkyl sulfonates and sulfamates may include but are not limited to methane, butane, ethane, propane, sulfonates and sulfamates.

Consistent with the above, suitable imidazolium compounds include, but are not limited to the following:

1-Methyl-3-Methylimidazolium (MMIM) chloride, nitrate, alkyl sulfonate or alkyl sulfamate;

1-Ethyl-3-Methylimidazolium (EMIM) chloride, nitrate, alkyl sulfonate or alkyl sulfamate;

1-Butyl-3-Methylimidazolium (BMIM) chloride, nitrate, alkyl sulfonate or alkyl sulfamate;

1-Hexyl-3-Methylimidazolium (HMIM) chloride, nitrate, alkyl sulfonate or alkyl sulfamate.

The metal salt can include but is not limited to salts of the metals, alkalis, rare earth and other salts such as, but not limited to, Li, Mg, Ca, Cr, Mn, Fe, Co, Ni, Cu, Zn, Cd, Pb, Bi, La, Ce, Al, Ag, Au, Ga, V, In, Nb, Mo, and W. The anion forming the metal salt can be the same as or different from L. The metal salt can be unhydrated or hydrated. Suitable metal salts include, but are not limited to: $ZnCl_2.2H_2O$, $CaCl_2.6H_2O$, $MgCl_2.6H_2O$, $CrCl_3.6H_2O$, $CoCl_2.6H_2O$, $LaCl_3.6H_2O$, $CuCl_2.2H_2O$, $LiCl.5H_2O$, $MoCl_5$, $WCl_6$, $Ca(NO_3)_2.4H_2O$, $Cr(NO_3)_3.9H_2O$, $Mn(NO_3)_2.4H_2O$, $Fe(NO_3)_3.9H_2O$, $Co(NO_3)_2.6H_2O$, $Ni(NO_3)_2.6H_2O$, $Cu(NO_3)_2.3H_2O$, $Li(NO_3).H_2O$, $Mg(NO_3)_2.6H_2O$, $La(NO_3)_3.6H_2O$, $Cd(NO_3)_2.4H_2O$, $Ce(NO_3)_3.6H_2O$, $Bi(NO_3)_3.5H_2O$, $Zn(NO_3)_2.4H_2O$, $Cd(OAc)_2.2H_2O$, $Pb(OAc)_2.3H_2O$, or $Cr_2(SO_4)_3.15H_2O$.

A suitable molar ratio of the imidazolium compound to the metal salt may be from about 0.1:4, to about 200:1, or from about 0.5:1 to about 100:1, or from about 1:1 to about 10:1, from about 1:1 to about 6:1, from about 1:1 to about 5:1, from about 2:1 to about 4:1, from about 2:1 to about 3:1 and in some embodiments about 2:1.

Surprisingly and unexpectedly, it has been found that the electrolyte should include an amount of water to achieve the formation of desired metal deposits that are thick, hard, and/or provide a shiny silvery metallic appearance. The amount or concentration of water (related to 1 M metallic salt concentration) to be included in the electrolyte is from about 0.1 M to about 55 M, from about 0.1 M to about 40 M, from about 1 M to about 30 M, from about 2 M to about 20 M, from about 2 M to about 10 M, or from about 1 M to about 55 M, or about 2 M to about 50 M, or from about 4 M to about 30 M, or from about 6 M to about 20 M.

The water for the electrolyte is provided by added water. In other words, the water included in the electrolyte is in addition to any water that is present or provided by the hydrated metal salt. Put another way, it has been found that any water that may be present from the hydrated metal salt (or the imidazolium compound) is not sufficient to produce the desired metal deposits. Accordingly, the electrolyte of the present invention must include added water.

The electrolytes according to the invention may be prepared by mixing together the imidazolium compound, the metal salt, and the added water. It is contemplated that the imidazolium compound and the metal salt are mixed together and, after mixed, water is added. The mixing may be carried out by heating, for example to about 70° C. or more. The resulting mixture remains a liquid, even generally at room temperature.

In one embodiment, it has been found that a suitable electrolyte includes an amount of alkyl imidazolium salt and chromium salt to provide a molar ratio of alkyl Imidazolium salt to chromium salt of about 2:1.

Electrodepositing

Plating equipment is well known and typically includes an electroplating tank that holds the electrolyte and is made of a suitable material inert to the electrolytic plating solution. The tank may have any suitable shape. The cathode substrate and anode are electrically connected by wiring and, respectively, to a rectifier (power supply). The cathode substrate for direct or pulse current has a net negative charge so that metal ions in the solution are reduced at the cathode substrate forming plated metal on the cathode surface. An oxidation reaction takes place at the anode.

Substrates are electroplated by contacting the substrate with the electrolyte of the present invention. The substrate typically functions as the cathode. An anode, which may be soluble or insoluble, is located within the electrolyte. Optionally, the cathode and anode may be separated by a membrane. Potential is typically applied between the anode and the cathode. Sufficient current density is applied and plating is performed for a period of time sufficient to deposit a metal layer, such as a chromium layer, having a desired thickness on the substrate.

Suitable current densities, include, but are not limited to, the range of about 1 to about 200 A/dm$^2$, or from about 1 to about 150 A/dm$^2$, or from about 2 to about 150 A/dm$^2$, or from about 5 to about 150 A/dm$^2$. Typically, the current density is in the range of about 5 to about 100 A/dm$^2$ when used to deposit chromium on a metal substrate. The applied current may be a direct current (DC), a pulse current (PC), a pulse reverse current (PRC) or other suitable current.

The electrolyte may be at a temperature in the range of about 20° to about 100° C. It is generally desirable that the temperature of the electrolyte be less than the boiling point of the electrolyte and generally be less than about 100° or 200°, or 300° C. so that evaporation of the added water does not occur or is minimized. In this regard, it may be suitable if the electrolyte is at a temperature between about 20° C. and 70° C.

In some embodiments, it may desirable to measure and/or to control the conductivity of the electrolyte. However, the conductivity will vary with the temperature of the electrolyte as well as the amount of added water. Nevertheless, the conductivity of the electrolyte should be within the range of about 1 to about 30 mS/cm.

The time to achieve the desired metal thickness can range from 10 seconds to 60 minutes or longer depending on the current density and other operating conditions. The thickness of the deposited metal is at least 0.1 μm, and in some embodiments the thickness can range from about 1 μm to about 500 μm, or from about 5 μm to about 100 μm, or from about 10 μm to about 50 μm, or from about 10 μm to about 20 μm.

EXAMPLES

A better understanding of the present invention may be obtained through the following examples that are set forth to illustrate, but are not to be construed as limiting.

Comparative Example 1

An electrolyte solution was prepared by mixing: 0.5 M of $Cr(NO_3)_3.9H_2O$ and 1 M of anhydrous EMIM Nitrate, which was poured into a Hull cell, a schematic of which is shown in FIG. 1.

Brass plates were prepared before plating by degreasing (acetone) and then activated with abrasive sand paper (grit 600) to eliminate surface oxidation. The brass plate was placed in the Hull cell along edge C. An insoluble anode type titanium mixed metal oxide ("TiMMO") anode was placed in the Hull cell along edge A. The brass plate and the TiMMO were connected to the negative and positive terminals respectively of a rectifier.

The temperature, current density (Intensity), and duration were varied as shown in Table 1 below. Table 1 presents the results.

TABLE 1

| No of Exp. | Amount of water in the solution for 1 mole of Cr salt (in M) | Temperature in ° C. (initial) | Voltage in V | Intensity in Hull Cell (A) initial | Duration in second | Results |
|---|---|---|---|---|---|---|
| 1 | 9 | 40 | 31 | 1.6 | 60 | No metallic deposit along the plate whatever was the current density. |
| 2 | 9 | 40 | 31 | 2 | 90 | |
| 3 | 9 | 50 | 31 | 2.7 | 90 | |
| 4 | 9 | 60 | 31 | 3.4 | 120 | |
| 5 | 9 | 70 | 31 | 3.7 | 120 | |
| 6 | 9 | 85 | 31 | 4.7 | 120 | |
| 7* | 9 | 50 | 31 | 2 | 120 | |

*Experiment 7 was conducted about 18 hours after experiments 1-6 to evaluate the evolution of the solution, No deposition of metallic chromium occurred on the Brass plate whatever the temperature and the cathodic current density were.

Comparative Example 2

An electrolyte solution was prepared according to Comparative Example 1 except water was added so that the electrolyte solution contained 11.2 moles of water. Results obtained are presented in Table 2.

TABLE 2

| No of Exp. | Amount of water in the solution for 1 mole of Cr salt (in M) | Temperature in ° C. (initial) | Voltage in V | Intensity in Hull Cell (A) initial | Duration in second | Results |
|---|---|---|---|---|---|---|
| 8 | 11.2 | 50 | 31 | 3.6 | 120 | No metallic deposit along the plate whatever was the current density. |
| 9 | 11.2 | 65 | 31 | 3.7 | 120 | |

Comparative Example 3

An electrolyte solution was prepared according to Comparative Example 1 except water was added so that the electrolyte solution contained 17.3 moles of water. Results obtained are presented in Table 3.

TABLE 3

| No of Exp. | Amount of water in the solution for 1 mole of Cr salt (in M) | Temperature in ° C. | Voltage in V | Intensity in Hull Cell (A) initial | Duration in second | Results |
|---|---|---|---|---|---|---|
| 10 | 17.3 | 60 | 29 | 10 | 120 | No metallic deposit along the plate whatever was the current density. |
| 11 | 17.3 | 50 | 21 (initial) | 5.3 | 120 | |
| 12 | 17.3 | 40 | 22 | 4.2 | 120 | |

Comparative Example 4

An electrolyte solution was prepared by mixing: 1 M of $Cr(NO_3)_3.9H_2O$ and 1 M of EMIM Nitrate, which was poured into a Hull cell, a schematic of which is shown in FIG. 1.

Brass plates were prepared before plating by degreasing (acetone) and then activated with abrasive sand paper (grit 600) to eliminate surface oxidation. The brass plate was placed in the Hull cell along edge C. An insoluble anode type titanium mixed metal oxide ("TiMMO") anode was placed in the Hull cell along edge A. The brass plate and the TiMMO were connected to the negative and positive terminals respectively of a rectifier.

The temperature and current density were varied as shown in Table 4 below, which presents the results.

TABLE 4

| No of Exp. | Amount of water in the solution for 1 mole of Cr salt (in M) | Temperature in ° C. (initial) | Voltage in V | Intensity in Hull Cell (A) initial | Duration in second | Results |
|---|---|---|---|---|---|---|
| 13 | 9 | 50 | 31 | 1 | 120 | No metallic deposit along the plate whatever was the current density. |
| 14 | 9 | 70 | 31 | 1.6 | 120 | |

No deposition of metallic chromium occurred on brass plate. For experiment 14, it appears that black stripes were unevenly distributed but were adherent on the plate, 0 and 3-3.5 cm measured on the plate from the higher current density, that correspond to approximately between 100 $A/dm^2$ to 10 $A/dm^2$.

Comparative Example 5

An electrolyte solution was prepared according to Comparative Example 4 except water was added so that the electrolyte solution contained 11.2 moles of water. Results obtained are presented in Table 5.

TABLE 5

| No of Exp. | Amount of water in the solution for 1 mole of Cr salt (in M) | Temperature in ° C. (initial) | Voltage in V | Intensity in Hull Cell (A) initial | Duration in second | Results (see meaning of different symbol) |
|---|---|---|---|---|---|---|
| 15 | 11.2 | 72 | 31 | 4 | 120 | No metallic deposit |
| 16 | 11.2 | 60 | 31 | 3.1 | 120 | along the plate |
| 17 | 11.2 | 50 | 31 | 1.8 | 120 | whatever was the |
| 18 | 11.2 | 40 | 31 | 1.6 | 120 | current density. |

No deposition of metallic chromium occurred on brass plate.

Comparative Example 6

An electrolyte solution was prepared according to Comparative Example 4 except water was added so that the electrolyte solution contained 17.3 moles of water. Results obtained are presented in Table 6.

TABLE 6

| No of Exp. | Amount of water in the solution for 1 mole of Cr salt (in M) | Temperature in ° C. (initial) | Voltage in V | Intensity in Hull Cell (A) initial | Duration in second | Results (see meaning of different symbol) |
|---|---|---|---|---|---|---|
| 19 | 17.3 | 40 | 31 | 6.7 | 120 | No metallic deposit |
| 20 | 17.3 | 50 | 31 | 8.9 | 120 | along the plate |
| 21 | 17.3 | 60 | 31 | 12 | 120 | whatever was the |
| 22 | 17.3 | 70 | 31 | 14 | 120 | current density. |
| 23 | 17.3 | 80 | 29 | 16 | 120 | |

No deposition of metallic chromium occurred on brass plate.

Comparative Example 7

An electrolyte solution was prepared by mixing: $CrCl3.6H_2O$ and EMIM Nitrate to provide a ratio of $CrCl_3$:EMIM nitrate of 1:2 and was poured into a Hull cell, a schematic of which is shown in FIG. 1.

Steel plates were prepared in an HCl wash. The steel plate was placed in the Hull cell along edge C. An insoluble anode type titanium mixed metal oxide ("TiMMO") anode was placed in the Hull cell along edge A. The steel plate and the insoluble anode were connected to the negative and positive terminals respectively of a rectifier. The temperature was varied from 40° C. to 60° C. and the current density was varied. It was found that there was no metallic deposit on the plate.

Comparative Example 8

A steel plate prepared according to Comparative Example 7 was placed in a Hull cell with an electrolyte solution that was prepared according to Comparative Example 7 except water was added so that the electrolyte solution contained 6 moles of water. The temperature was varied from 40° C. to 60° C. and the current density was varied. It was found that there was no metallic deposit on the plate.

Comparative Example 9

A steel plate prepared according to Comparative Example 7 was placed in a Hull cell with an electrolyte solution prepared according to Comparative Example 7 except water was added so that the solution contained 9 moles of water. The temperature was varied from 40° C. to 60° C. and the current density was varied. It was found that there was no metallic deposit on the plate.

Comparative Example 10

A steel plate prepared according to Comparative Example 7 was placed in a Hull cell with an electrolyte solution prepared according to Comparative Example 7 except water was added so that the solution contained 12 moles of water. The temperature was varied from 40° C. to 60° C. and the current density was varied. It was found that there was no metallic deposit on the plate.

Comparative Example 11

A steel plate prepared according to Comparative Example 7 was placed in a Hull cell with an electrolyte solution prepared according to Comparative Example 7 except water was added so that the solution contained 18 moles of water. The temperature was varied from 40° C. to 60° C. and the current density was varied. It was found that there was no metallic deposit on the plate.

Comparative Example 12

An electrolyte solution was prepared by mixing: $CrCl_3.6H_2O$ and BMIM Chloride to provide a ratio of $CrCl_3$:BMIM chloride of 1:2 and was poured into a Hull cell, a schematic of which is shown in FIG. 1.

Brass plates were prepared by degreasing (acetone) and then activated with abrasive sand paper (grit 600) to eliminate surface oxidation. The brass plate was placed in the Hull cell along edge C. An insoluble anode type titanium mixed metal oxide ("TiMMO") anode was placed in the Hull cell along edge A. The brass plate and the insoluble anode were connected to the negative and positive terminals respectively of a rectifier.

The temperature and current density (Intensity) were varied as shown in Table 7 below, which presents the results.

TABLE 7

| No of Exp. | Nature of plate | Amount of water in the solution for 1 mole of Cr salt (in M) | Temperature in ° C. (initial) | Voltage in V | Intensity in Hull Cell (A) initial | Duration in second | Results |
|---|---|---|---|---|---|---|---|
| 0 | Brass | 3.45 | 40 | Solution too viscous | | | |
| 0 | Brass | 3.45 | 50 | | | | |
| 11 | Brass | 3.45 | 55 | 32 | 0.4 (?) | 90 | Black stripes |
| 12 | Brass | 3.45 | 65 | 31 | 0.6 | 90 | More black with metallic stripes |
| 3 | Brass | 3.45 | 80 | 31 | 1.1 | 90 | Violet coloration |

No deposition of real metallic chromium occurs on the plate whatever have been the temperature, and the cathodic current density. However, persistent black stripes and a violet coloration suggest that reduction reaction of chromium ions is present at cathodic surface.

Example 1

An electrolyte solution was prepared according to Comparative Example 12 except water was added so that the electrolyte solution contained 6 moles of water. The temperature was varied from 40° C. to 70° C. and the current density was varied. Results obtained are presented in Table 8.

TABLE 8

Figure 2A:
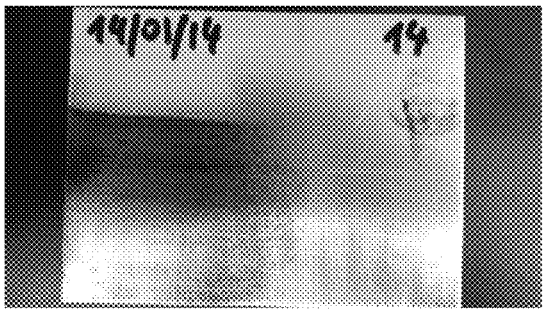
FIGS. 2A-2D are photographs of substrates treated with the method and electrolyte of Example 1.
Figure 2B:
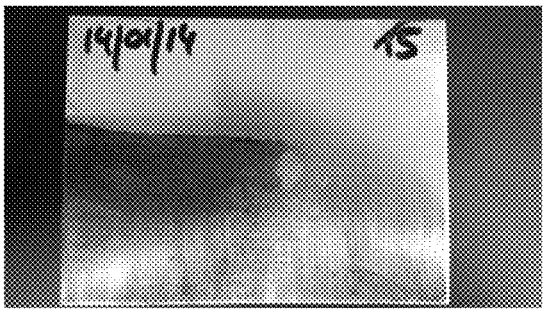
Figure 2C:
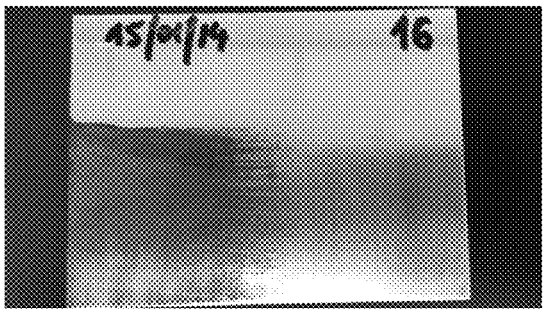
Figure 2D:
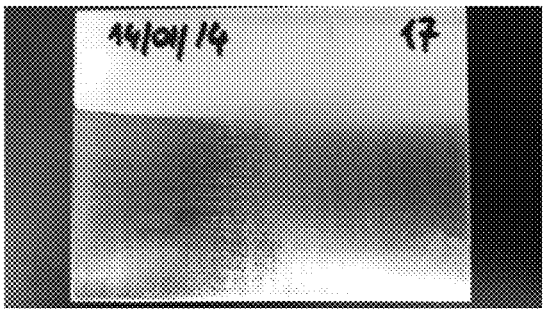

| No of Exp. | Nature of plate | Amount of water in the solution for 1 mole of Cr salt (in M)) | Temperature in ° C. (initial) | Voltage in V | Intensity in Hull Cell (A) initial | Duration in second | Results |
|---|---|---|---|---|---|---|---|
| 14 | Brass | 6 | 40 | 31 | 1 | 90 | Chrome plated on about 4 cm See FIG. 2A |
| 17 | Brass | 6 | 50 | 31 | 1.3 | 90 | Chrome plated on about 3.5 cm See FIG. 2B |
| 16 | Brass | 6 | 60 | 31 | 1.7 | 90 | Chrome plated on about 3 cm See FIG. 2C |
| 15 | Brass | 6 | 70 | 31 | 2.2 | 90 | Chrome plated non uniformly (3 to 5 cm) See FIG. 2D |

On each plate, deposition of good metallic chromium appears. Pictures of each plate are provided at FIGS. 2A-2D. The length of the plated surfaces decreases as a function of the bath temperature and at 70° C., the chromium plating occurs unevenly.

Example 2

An electrolyte solution was prepared according to Comparative Example 12 except water was added so that the electrolyte solution contained 9 moles of water. The temperature was varied from 40° C. to 70° C. and the current density was varied. Results obtained are presented in Table 9.

TABLE 9

Figure 3A:
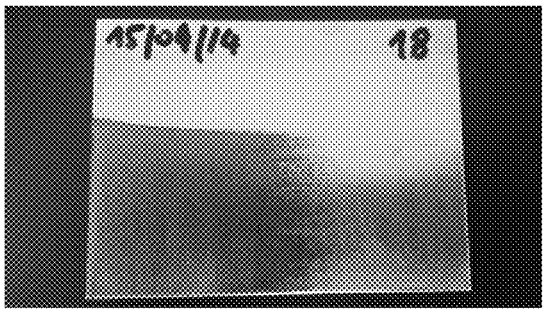
Figure 3B:
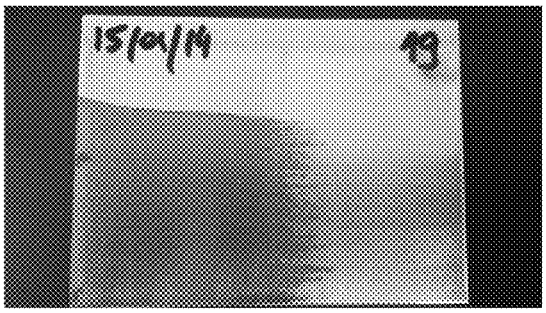
Figure 3C:
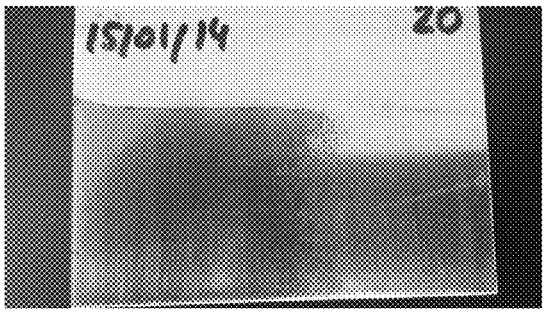
Figure 3D:
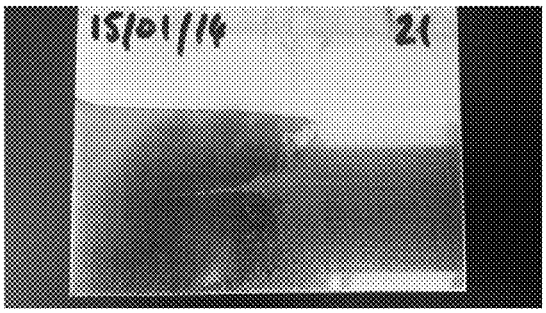

| No of Exp. | Nature of plate | Amount of water in the solution for 1 mole of Cr salt (in M) | Temperature in ° C. (initial) | Voltage in V | Intensity in Hull Cell (A) initial | Duration in second | Results |
|---|---|---|---|---|---|---|---|
| 18 | Brass | 9 | 40 | 31 | 2.3 | 90 | Chrome plated on about 5.5 cm See FIG. 3A |
| 19 | Brass | 9 | 50 | 31 | 3.1 | 90 | Chrome plated on about 5.5 cm See FIG. 3B |
| 20 | Brass | 9 | 60 | 31 | 4.2 | 90 | Chrome plated on about 6 cm See FIG. 3C |
| 21 | Brass | 9 | 70 | 31 | 5.2 | 90 | Chrome plated non uniformly (4 to 5 cm) See FIG. 3D |

On each plate, deposition of good metallic chromium appears. Pictures of each plate are provided at FIGS. 3A-3D.

Example 3

An electrolyte solution was prepared according to Comparative Example 12 except water was added so that the electrolyte solution contained 12 moles of water. The temperature was varied from 40° C. to 70° C. and the current density was varied. Results obtained are presented in Table 10.

TABLE 10

Figure 4A:
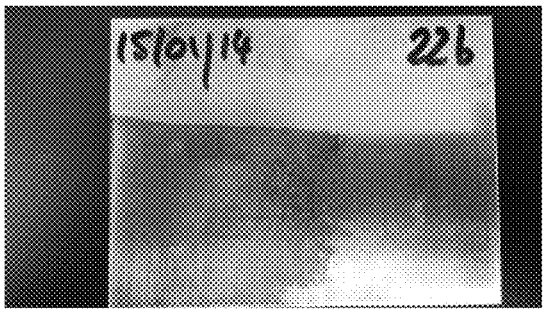
FIGS. 4A-4D are photographs of substrates treated with the method and electrolyte of Example 3.
Figure 4B:
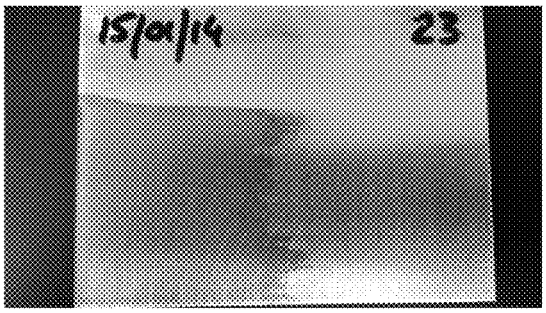
Figure 4C:
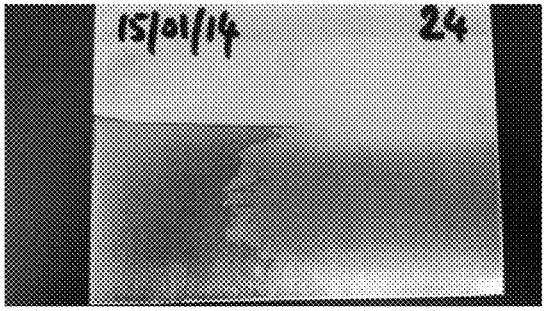
Figure 4D:
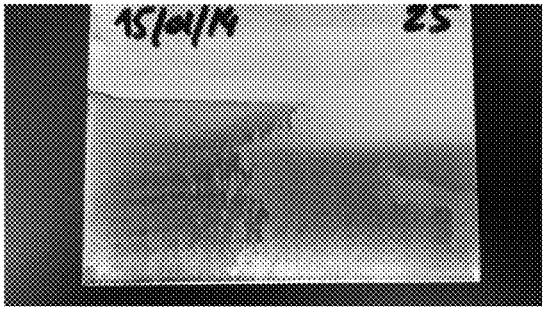

| No of Exp. | Nature of plate | Amount of water in the solution for 1 mole of Cr salt (in M) | Temperature in ° C. (initial) | Voltage in V | Intensity in Hull Cell (A) initial | Duration in second | Results |
|---|---|---|---|---|---|---|---|
| 22b | Brass | 12 | 40 | 31 | 4 | 90 | Chrome plated on about 5 cm See FIG. 4A |
| 23 | Brass | 12 | 50 | 31 | 5.5 | 90 | Chrome plated on about 4.5 cm See FIG. 4B |
| 24 | Brass | 12 | 60 | 31 | 6.5 | 90 | Chrome plated on about 3 cm See FIG. 4C |
| 25 | Brass | 12 | 70 | 31 | 8 | 90 | Chrome plated non uniformly (3 cm) See FIG. 4D |

On each plate, deposition of good metallic chromium appears. Pictures of each plate are provided at FIGS. 4A-4D.

Example 4

An electrolyte solution was prepared according to Comparative Example 12 except water was added so that the solution contained 18 moles of water. The temperature was varied from 40° C. to 70° C. and the current density was varied. Results obtained are presented in Table 11.

TABLE 11

Figure 5A:
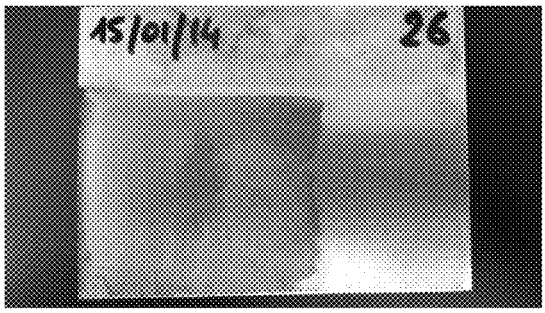
FIGS. 5A-5D are photographs of substrates treated with the method and electrolyte of Example 4.
Figure 5B:
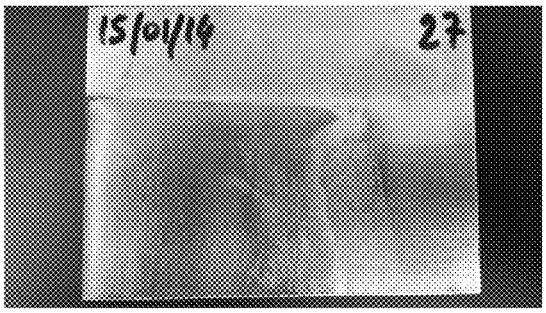
Figure 5C:
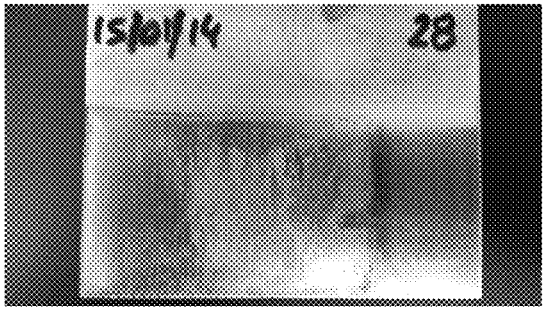
Figure 5D:
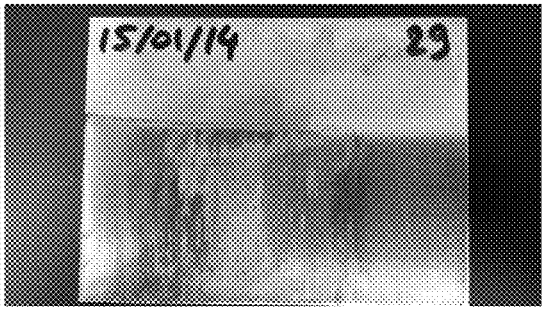

| No of Exp. | Nature of plate | Amount of water in the solution for 1 mole of Cr salt (in M) | Temperature in ° C. (initial) | Voltage in V | Intensity in Hull Cell (A) initial | Duration in second | Results |
|---|---|---|---|---|---|---|---|
| 26 | Brass | 18 | 40 | 30 | 9.4 | 90 | Chrome plated on about 6 cm See FIG. 5A |
| 27 | Brass | 18 | 50 | 29.5 | 9.1 | 90 | Chrome plated on about 6 cm (with burnt areas) See FIG. 5B |
| 28 | Brass | 18 | 60 | 29 | 11 | 90 | Chrome plated on about 5 cm (with stripes) See FIG. 5C |

TABLE 11-continued

| No of Exp. | Nature of plate | Amount of water in the solution for 1 mole of Cr salt (in M) | Temperature in ° C. (initial) | Voltage in V | Intensity in Hull Cell (A) initial | Duration in second | Results |
|---|---|---|---|---|---|---|---|
| 29 | Brass | 18 | 70 | 29 | 12 | 90 | Chrome plated on about 4 cm (with stripes) See FIG. 4D |

On each plate, deposition of good metallic chromium appears. Pictures of each plate are provided at FIGS. 5A-5D.

Example 5

An electrolyte solution was prepared by mixing: $CrCl_3.6H_2O$ and EMIM Chloride to provide a ratio of $CrCl_3$:EMIM chloride of 1:2 and was poured into a Hull cell, a schematic of which is shown in FIG. 1.

Brass plates were prepared before plating by degreasing (acetone) and then activated with abrasive sand paper (grit 600) to eliminate surface oxidation. The brass plate was placed in the Hull cell along edge C. An insoluble anode type titanium mixed metal oxide ("TiMMO") anode was placed in the Hull cell along edge A. The brass plate and the insoluble anode were connected to the negative and positive terminals respectively of a rectifier.

The temperature, current density (Intensity) and amount of water were varied as shown in Table 12 below, which presents the results.

TABLE 12

| No of Exp. | Nature of plate | Amount of water in the solution for 1 mole of Cr salt (in M) | Temperature in ° C. (initial) | Voltage in V | Intensity in Hull Cell (A) initial | Duration in second | Results |
|---|---|---|---|---|---|---|---|
| 42 | Brass | 4.03 | 60 | 31 | 0.9 | 90 | FIG. 6A |
| 43 | Brass | 6 | 40 | 31 | 1.2 | 90 | FIG. 6B |
| 44 | Brass | 6 | 50 | 31 | 1.5 | 90 | FIG. 6C |
| 45 | Brass | 6 | 60 | 30 | 2.2 | 90 | FIG. 6D |
| 46 | Brass | 9 | 40 | 31 | 3.6 | 90 | FIG. 6E |
| 47 | Brass | 9 | 50 | 31 | 4.7 | 90 | FIG. 6F |
| 48 | Brass | 9 | 60 | 30 | 5.6 | 90 | FIG. 6G |
| 49 | Brass | 12 | 40 | 31 | 6.0 | 90 | FIG. 6H |
| 50 | Brass | 12 | 50 | 31 | 7.3 | 90 | FIG. 61 |
| 51 | Brass | 12 | 60 | 30 | 9 | 90 | FIG. 6J |
| 52 | Brass | 18 | 40 | 29 | 11 | 90 | FIG. 6K |
| 53 | Brass | 18 | 50 | 29 | 12.5 | 90 | FIG. 6L |
| 54 | Brass | 18 | 60 | 29 | 17 | 90 | FIG. 6AM |

The experiments of Example 5 demonstrate that metallic chromium deposition was achieved with the described electrolyte.

Example 6

An electrolyte solution was prepared by mixing: $CrCl_3.6H_2O$ and HMIM Chloride to provide a ratio of $CrCl_3$:HMIM chloride of 1:2 and was poured into a Hull cell, a schematic of which is shown in FIG. 1.

Brass plates were prepared before plating by degreasing (acetone) and then activated with abrasive sand paper (grit 600) to eliminate surface oxidation. The brass plate was placed in the Hull cell along edge C. A DSA was placed in the Hull cell along edge A. The brass plate and the DSA were connected to the negative and positive terminals respectively of a rectifier.

The temperature, current density (Intensity) and amount of water were varied as shown in Table 13 below, which presents the results.

TABLE 13

Figures 7A, 7B, 7C, 7D:
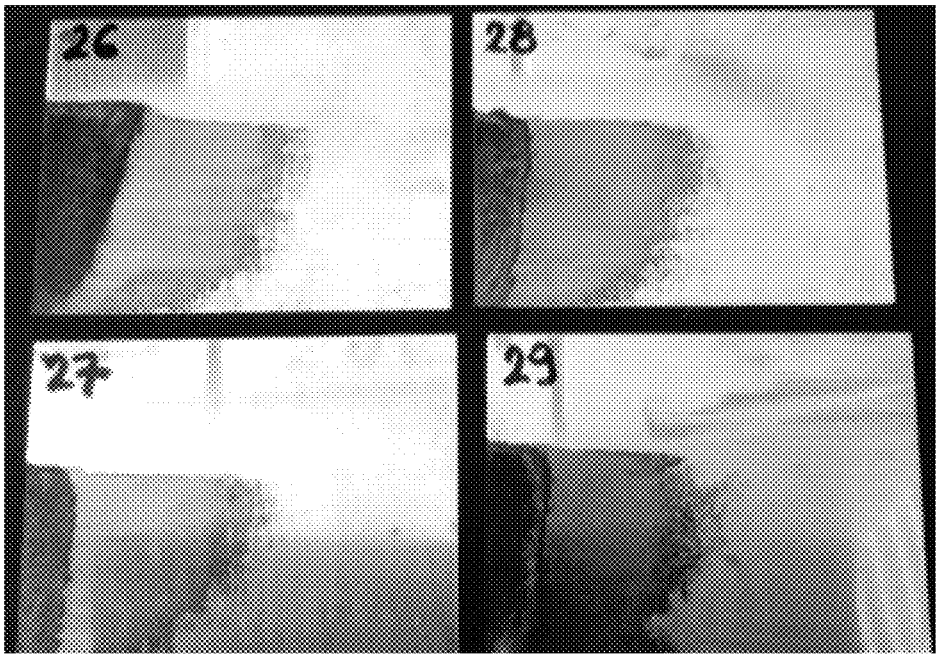
FIGS. 7A-7N are photographs of substrates treated with the method and electrolyte of Example 6.
Figures 7E, 7F, 7G, 7H, 7I, 7J:
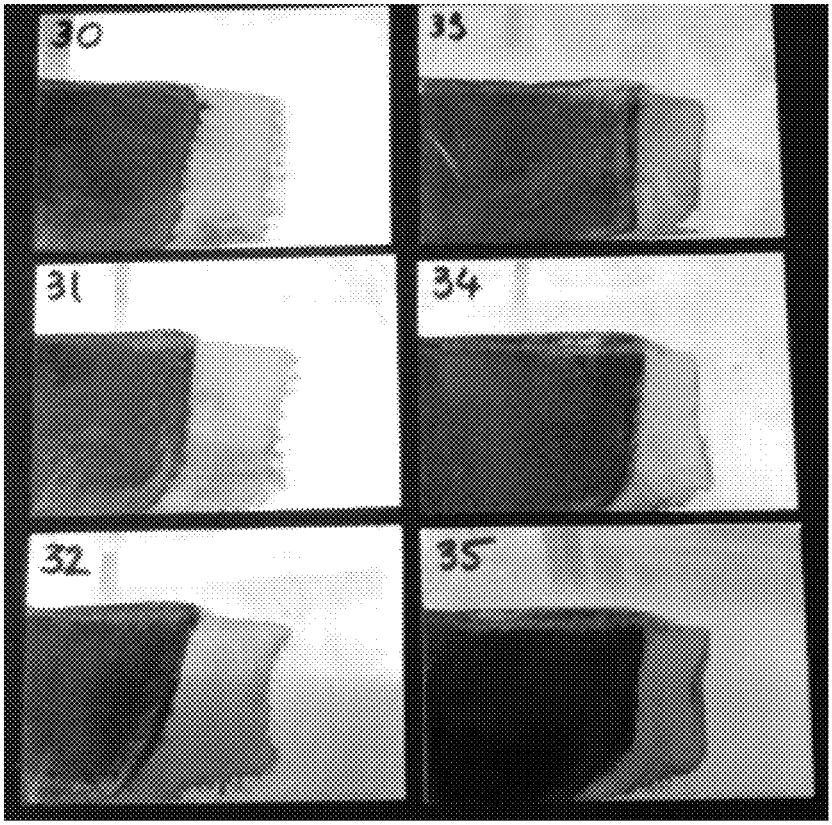
Figures 7K, 7L, 7M, 7N:
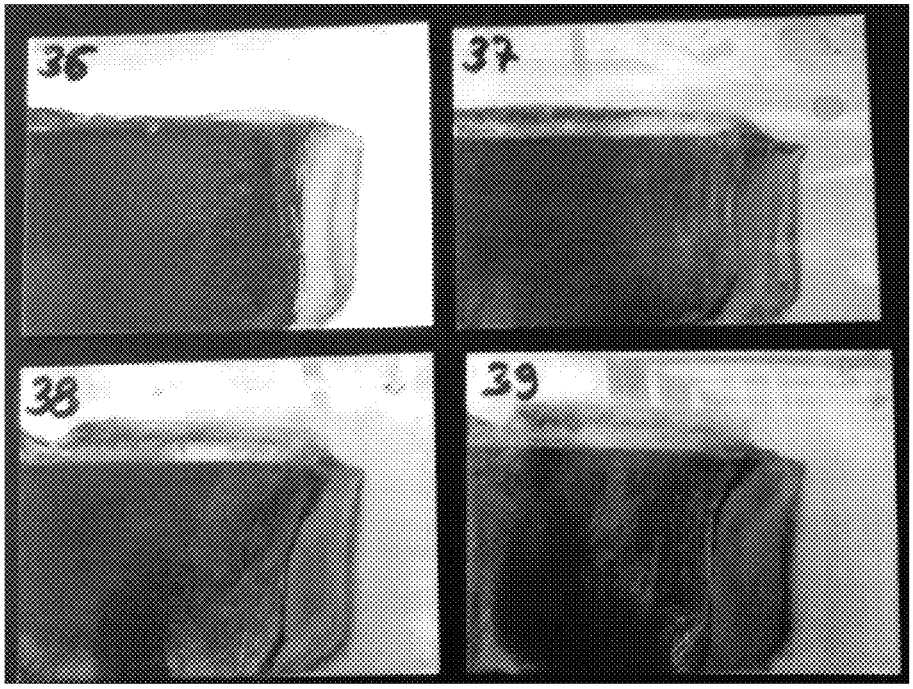

| No of Exp. | Nature of plate | Amount of water in the solution for 1 mole of Cr salt (in M) | Temperature in ° C. (initial) | Voltage in V | Intensity in Hull Cell (A) initial | Duration in second | Results |
|---|---|---|---|---|---|---|---|
| 26 | Brass | 6 | 70 | 31 | 2.8 | 90 | FIG. 7A |
| 27 | Brass | 6 | 60 | 31 | 2 | 90 | FIG. 7B |
| 28 | Brass | 6 | 50 | 31 | 1.5 | 90 | FIG. 7C |
| 29 | Brass | 6 | 40 | 31 | 1.1 | 90 | FIG. 7D |
| 30 | Brass | 9 | 40 | 31 | 2.7 | 90 | FIG. 7E |
| 31 | Brass | 9 | 50 | 31 | 3.7 | 90 | FIG. 7F |
| 32 | Brass | 9 | 60 | 31 | 4.7 | 90 | FIG. 7G |
| 33 | Brass | 12 | 40 | 31 | 4.7 | 90 | FIG. 7H |
| 34 | Brass | 12 | 50 | 31 | 5.5 | 90 | FIG. 7I |
| 35 | Brass | 12 | 60 | 31 | 7 | 90 | FIG. 7J |
| 36 | Brass | 18 | 40 | 30 | 4.8 | 90 | FIG. 7K |
| 37 | Brass | 18 | 40 | 30 | 7.5 | 90 | FIG. 7L |
| 38 | Brass | 18 | 50 | 30 | 9.5 | 90 | FIG. 7M |
| 39 | Brass | 18 | 60 | 29 | 11 | 90 | FIG. 7N |

The experiments of Example 6 demonstrate the efficacy of deposition of metallic chromium and black chromium with the tested electrolyte. The black chromium deposition which is present on certain plates (e.g. plates 34-39) may be useful for black chromium deposition applications such are solar application (photons absorber), decorative application (automotive industry), furnishing, army (decreasing reflection on firearm parts, etc.).

Example 7

An electrolyte solution was prepared by mixing: $CrCl_3.6H_2O$ and BMIM Chloride and was poured into a Hull cell, a schematic of which is shown in FIG. 1. In Experiments 12-16, the ratio of $CrCl_3$:BMIM chloride was 1:4. In Experiments 17-18, the ratio of $CrCl_3$:BMIM chloride was 1:2. In Experiments 19-20, the ratio of $CrCl_3$:BMIM chloride was 1:2.5. In Experiments 21-24, the ratio of $CrCl_3$:BMIM chloride was 1:2.

Brass plates were prepared before plating by degreasing (acetone) and then activated with abrasive sand paper (grit 600) to eliminate surface oxidation. The brass plate was placed in the Hull cell along edge C. An insoluble anode type titanium mixed metal oxide ("TiMMO") anode was placed in the Hull cell along edge A. The brass plate and the insoluble anode were connected to the negative and positive terminals respectively of a rectifier.

The temperature, current density (Intensity) and amount of water were varied as shown in Table 14 below, which presents the results.

TABLE 14

| No of Exp. | Nature of plate | Amount of water in the solution for 1 mole of Cr salt (in M) | Temperature in ° C. (initial) | Voltage in V | Intensity in Hull Cell (A) initial | Duration in second | Results |
|---|---|---|---|---|---|---|---|
| 12 | Brass | 6 | 40 | 31 | 2.2 | 90 | FIG. 8A |
| 13 | Brass | 6 | 50 | 31 | 2.7 | 90 | FIG. 8B |
| 14 | Brass | 6 | 60 | 31 | 3.8 | 90 | FIG. 8C |
| 15 | Brass | 12 | 40 | 31.5 | 7 | 90 | FIG. 8D |
| 16 | Brass | 12 | 60 | 31 | 10 | 90 | FIG. 8E |
| 17 | Brass | 12.7 | 40 | 30 | 5.9 | 90 | FIG. 8F |
| 18 | Brass | 12.7 | 60 | 30 | 8.7 | 90 | FIG. 8G |
| 19 | Brass | 13.28 | 40 | 30 | 5.5 | 90 | FIG. 8H |
| 20 | Brass | 13.28 | 60 | 30 | 7.5 | 90 | FIG. 8I |
| 21 | Brass | 14.1 | 40 | 31 | 3.5 | 90 | FIG. 8J |
| 22 | Brass | 14.1 | 50 | 31 | 4.7 | 90 | FIG. 8K |
| 23 | Brass | 14.1 | 60 | 31 | 6.3 | 90 | FIG. 8L |
| 24 | Brass | 18 | 40 | 31 | 5.3 | 90 | FIG. 8M |

The experiments of Example 7 demonstrate that metallic chromium deposition was achieved with the described electrolyte.

Example 8 Deposition on Steel Rods

Deposition on two steel rods (1 and 2) was investigated. Each were prepared by degreasing in ethyl alcohol, water and acetone, thereafter activation (dipped) in HCl solution (¼ HCl+water), surface abrasion using abrasive paper (grid 600), Anodic etching in Sulfuric acid/water solution: 30 $A/dm^2$, with titanium MMO plate cathode for about 1 min., and rinsed in deionized water. Steel rod 1 had a diameter of 0.25 in. and steel rod 2 had a diameter of 0.5 in.

The treated steel rods (Cathodes) were placed in the middle of the Titanium MMO (Mixed Metal Oxide) basket used as an insoluble anode, and the anode and cathode were immersed in the electrolytic solution contained in a beaker. An electrolyte solution was prepared by mixing: $CrCl_3.6H_2O$ and BMIM Chloride to provide a ratio of $CrCl_3$:BMIM chloride of 1:2.

Deposition was conducted at an average current density of 15-20 $A/dm^2$, at a temperature of 40 to 48° C. The period of deposition for steel rod 1 was about 15 and the period of deposition for steel rod 2 was about 21 minutes. The thickness of the deposited metal was about 15 μm for steel rod 1 and about 20 μm for steel rod 2.

Figure 9:
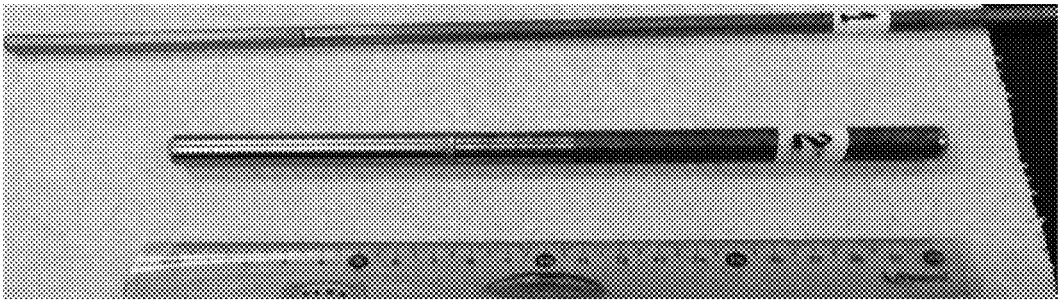
FIG. 9 is a photograph of steel rods treated with the method and electrolyte of Example 8.

FIG. 9 shows a picture of steel rods 1 and 2 after plating. It was observed that deposition was uniform and did not present nodules or a burnt area.

Example 9

Steel rods were prepared by turning of the rod. The treated steel rods (Cathodes) were placed in the middle of the Titanium MMO (Mixed Metal Oxide) basket used as an insoluble anode and, the anode and cathode were immersed in the electrolytic solution contained in a beaker. An electrolyte solution was prepared by mixing: $CrCl_3.6H_2O$ and BMIM Chloride to provide a ratio of $CrCl_3$:BMIM chloride of 1:2.

Deposition was conducted at an average current density of 15-20 A/dm$^2$, at a temperature of 35 to 45° C. for about 15 minutes. The thickness of the deposited metal was about 10 μm. Deposition was also conducted at an average current density of 15-20 A/dm$^2$, at a temperature of 40 to 48° C. for about 21 minutes. The thickness of the deposited metal was about 20 μm.

Figure 10:
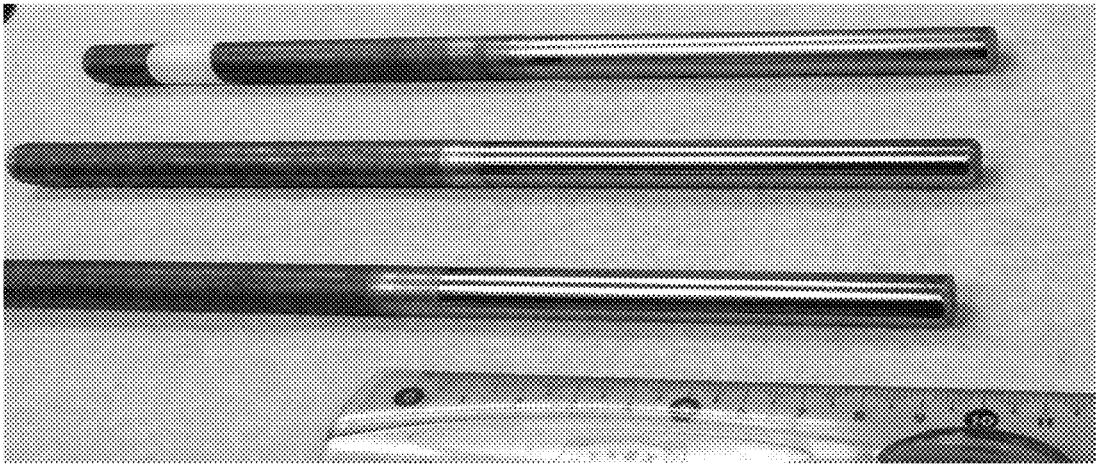
FIG. 10 is a photograph of steel rods treated with the method and electrolyte of Example 9.

FIG. 10 shows a picture of the steel rods of Example 9. The treated portion of the rods were very smooth and shiny with a metallic aspect. The Cr deposits were without pits.

Accordingly, it has been found that the use of the above-described ionic liquid electrolyte and method for depositing metals provides a silvery, metallic, bright, shiny lustrous surface appearance (not black and dull, matte, appearance) with a desired hardness.

It is therefore intended that the foregoing detailed description be regarded as illustrative rather than limiting, and that it be understood that it is the following claims, including all equivalents, that are intended to define the spirit and scope of this invention.

The invention claimed is:

1. An electrolyte for electrodepositing metals on a substrate comprising an imidazolium compound, a metal salt, and water, wherein the imidazolium compound has formula (1):

(1)

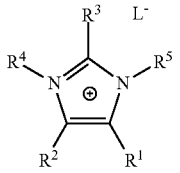

wherein $R^1$, $R^2$, $R^3$, $R^4$, and $R^5$ are each independently selected from the group consisting of an H atom and an organic radical, and $L^-$ is a compatible anion, wherein the ratio of imidazolium compound to metal salt is from 0.1:4 to 200:1, and wherein the water is present in the electrolyte in an amount from 6 M to 50 M.

2. The electrolyte of claim 1, wherein $R^1$, $R^2$, $R^3$, $R^4$, and $R^5$ are each independently selected from the group consisting of an H atom and an organic radical of from 1 to 20 carbon atoms.

3. The electrolyte of claim 1, wherein $L^-$ is selected from the group consisting of chloride, carboxylate anions, oxides, organic sulfite or sulfate, inorganic sulfite or sulfate, sulfonate, sulfamate, carbonate, nitrate, nitrite, thiocyanate, hydroxide, sulfonylimide, phosphates, phosphonates, phosphinates, phosphites, phosphonites and phosphinites, borates, carboxylates, and acetates.

4. The electrolyte of claim 1, wherein $L^-$ is nitrate, chloride, sulfonate, or sulfamate.

5. The electrolyte of claim 1, wherein the metal salt is a hydrated metal salt.

6. The electrolyte of claim 1, wherein the metal salt is selected from the group consisting of Li, Mg, Ca, Cr, Mn, Fe, Co Ni, Cu, Zn, Cd, Pb, Bi, La, Ce, Al, Ag, Au, Ga, V, In, Nb, Mo, and W.

7. The electrolyte of claim 1, wherein the imidazolium compound is selected from the group consisting of 1-Methyl-3-Methylimidazolium (MMIM) chloride, nitrate, alkyl sulfonate, and alkyl sulfamate; 1-Ethyl-3-Methylimidazolium (EMIM) chloride, nitrate, alkyl sulfonate, and alkyl sulfamate; 1-Butyl-3-Methylimidazolium (BMIM) chloride, nitrate, alkyl sulfonate, and alkyl sulfamate; 1-Hexyl-3-Methylimidazolium (HMIM) chloride, nitrate, alkyl sulfonate, and alkyl sulfamate, and wherein the metal salt is selected from the group consisting of $ZnCl_2.2H_2O$, $CaCl_2.6H_2O$, $MgCl_2.6H_2O$, $CrCl_3.6H_2O$, $CoCl_2.6H_2O$, $LaCl_3.6H_2O$, $CuCl_2.2H_2O$, $LiCl.5H_2O$, $MoCl_5$, $WCl_6$, $Ca(NO_3)_2.4H_2O$, $Cr(NO_3)_3.9H_2O$, $Mn(NO_3)_2.4H_2O$, $Fe(NO_3)_3.9H_2O$, $Co(NO_3)_2.6H_2O$, $Ni(NO_3)_2.6H_2O$, $Cu(NO_3)_2.3H_2O$, $Li(NO_3).H_2O$, $Mg(NO_3)_2.6H_2O$, $La(NO_3)_3.6H_2O$, $Cd(NO_3)_2.4H_2O$, $Ce(NO_3)_3.6H_2O$, $Bi(NO_3)_3.5H_2O$, $Zn(NO_3)_2.4H_2O$, $Cd(OAc)_2.2H_2O$, $Pb(OAc)_2.3H_2O$, and $Cr_2(SO_4)_3.15H_2O$.

8. The electrolyte of claim 7, wherein the imidazolium compound is selected from the group consisting of 1-Methyl-3-Methylimidazolium (MMIM) chloride, 1-Ethyl-3-Methylimidazolium (EMIM) chloride, 1-Butyl-3-Methylimidazolium (BMIM) chloride, and 1-Hexyl-3-Methylimidazolium (HMIM) chloride, and the metal salt is $CrCl_3.6H_2O$.

9. The electrolyte of claim 1, wherein the water is present at a concentration of 6 M to 40 M.

10. The electrolyte of claim 1, wherein the water is present at a concentration of 6 M to 30 M.

11. The electrolyte of claim 1, wherein the molar ratio of imidazolium compound to metal salt is between 0.5:1 and 100:1.

12. The electrolyte of claim 1, wherein the metal of the metal salt is Cr.

13. The electrolyte of claim 1, wherein the imidazolium compound, the metal salt, and water are present in sufficient quantities to electrodeposit a thickness of a metal on the substrate from 1 μm to 500 μm.

* * * * *